US008822019B2

(12) United States Patent
Chen et al.

(10) Patent No.: US 8,822,019 B2
(45) Date of Patent: Sep. 2, 2014

(54) COATED ARTICLE AND METHOD FOR MAKING SAME

(75) Inventors: Wen-Rong Chen, New Taipei (TW); Cheng-Shi Chen, New Taipei (TW); Ying-Ying Wang, Shenzhen (CN); Zhi-Jie Hu, Shenzhen (CN); Cong Li, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 250 days.

(21) Appl. No.: 13/238,176

(22) Filed: Sep. 21, 2011

(65) Prior Publication Data

US 2013/0029097 A1 Jan. 31, 2013

(30) Foreign Application Priority Data

Jul. 29, 2011 (CN) ..... 2011 1 0215435

(51) Int. Cl.
*B32B 17/06* (2006.01)

(52) U.S. Cl.
USPC ..... 428/216; 428/336; 428/469; 428/472; 428/698

(58) Field of Classification Search
USPC ..... 428/216, 336, 469, 472, 698
See application file for complete search history.

(56) References Cited

U.S. PATENT DOCUMENTS

| | | | | |
|---|---|---|---|---|
| 4,763,601 | A * | 8/1988 | Saida et al. | 118/718 |
| 5,079,089 | A * | 1/1992 | Ito et al. | 428/336 |
| 5,427,843 | A * | 6/1995 | Miyajima et al. | 428/469 |
| 2002/0192473 | A1 * | 12/2002 | Gentilhomme et al. | 428/216 |
| 2007/0275264 | A1 * | 11/2007 | Hultin et al. | 428/687 |
| 2008/0038579 | A1 * | 2/2008 | Schuisky et al. | 428/640 |
| 2009/0181262 | A1 * | 7/2009 | Isaksson et al. | 428/626 |

FOREIGN PATENT DOCUMENTS

| | | | |
|---|---|---|---|
| JP | 02-122064 | * | 5/1990 |
| JP | 04-193968 | * | 7/1992 |

* cited by examiner

*Primary Examiner* — Archene Turner
(74) *Attorney, Agent, or Firm* — Novak Druce Connolly Bove + Quigg LLP

(57) ABSTRACT

A coated article includes a substrate, a first layer deposited on the substrate, a second layer deposited on the first layer and a third layer deposited on the second layer. The first layer substantially consists of one material selected from the group consisting of Al layer, Al alloy layer, Zn layer or Zn alloy layer. The first layer is white. The second layer substantially includes metal M', O and N, wherein M' is Al or Zn. The third layer is an aluminum oxide layer or a silicon oxide layer. The third layer has an anti-fingerprint property.

14 Claims, 4 Drawing Sheets

COATED ARTICLE AND METHOD FOR MAKING SAME

CROSS-REFERENCE TO RELATED APPLICATIONS

This application is one of the six related co-pending U.S. patent applications listed below. All listed applications have the same assignee. The disclosure of each of the listed applications is incorporated by reference into the other listed applications.

| U.S. Application Ser. No. | Title | Inventors |
|---|---|---|
| 13/238,157 | COATED ARTICLE AND METHOD FOR MAKING SAME | HUANN-WU CHIANG et al. |
| 13/238,160 | COATED ARTICLE AND METHOD FOR MAKING SAME | HUANN-WU CHIANG et al. |
| 13/238,164 | COATED ARTICLE AND METHOD FOR MAKING SAME | HSIN-PEI CHANG et al. |
| 13/238,169 | COATED ARTICLE AND METHOD FOR MAKING SAME | WEN-RONG CHEN et al. |
| 13/238,170 | COATED ARTICLE AND METHOD FOR MAKING SAME | HSIN-PEI CHANG et al. |
| 13/238,176 | COATED ARTICLE AND METHOD FOR MAKING SAME | WEN-RONG CHEN et al. |

BACKGROUND

1. Technical Field

The exemplary disclosure generally relates to coated articles and a method for manufacturing the coated articles, particularly coated articles having a bone china-like appearance with an anti-fingerprint property and a method for making the coated articles.

2. Description of Related Art

Spraying can be used to deposit a white layer on housings of portable electronic devices to give the housings a white ceramic-like appearance. However, the layers formed by spraying cannot present with a high level of whiteness, brightness, and translucent appearance like a bone china.

Additional, an anti-fingerprint layer coating can be added to protect the housing from fingerprint. In order not to affect the appearance of housing, the anti-fingerprint layer should have a high translucency and glossiness. However, the anti-fingerprint layers formed by the spraying, physical vapor deposition and chemical vapor deposition cannot present a good transparency.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the exemplary coated article and method for manufacturing the coated article. Moreover, in the drawings like reference numerals designate corresponding parts throughout the several views. Wherever possible, the same reference numbers are used throughout the drawings to refer to the same or like elements of an embodiment.

DETAILED DESCRIPTION

Figure 1:
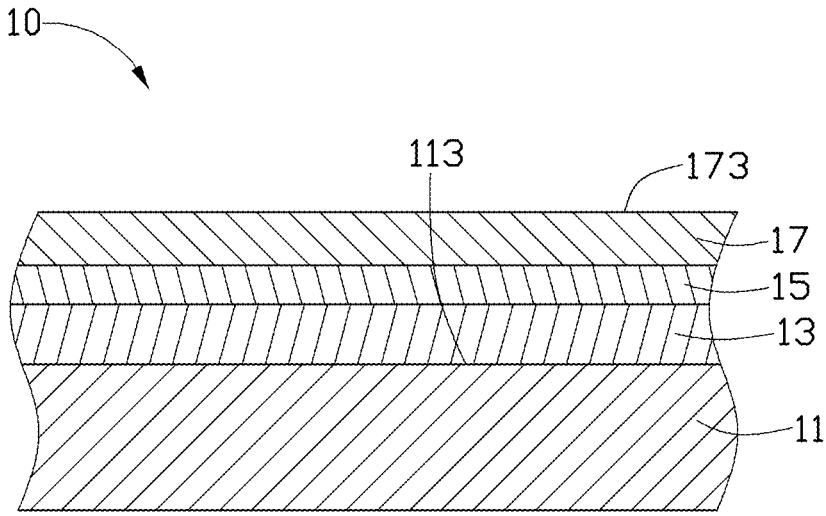
FIG. 1 is a cross-sectional view of an exemplary embodiment of coated article.

FIG. 1 shows an exemplary embodiment of a coated article. The coated article 10 includes a substrate 11, a first layer 13 formed on the substrate 11, a second layer 15 formed on the first layer 13 and a third layer 17 formed on the second layer 15. The coated article 10 may be a housing of a mobile phone, personal digital apparatus (PDA), notebook computer, portable music players, GPS navigator, or digital camera.

The substrate 11 may be made of metal, such as stainless steel, aluminum, aluminum alloy, magnesium and magnesium alloy. The substrate 11 may instead be made of nonmetal material, such as plastic.

The first layer 13 may substantially consist of one material selected from the group consisting of aluminum, aluminum alloy, zinc, and zinc alloy. When the first layer 13 consists of aluminum alloy, the mass percentage of Al is about 80-90%. When the first layer 13 consists of zinc alloy, the mass percentage of Zn is about 80-90%. The first layer 13 has an L* value between about 85 to about 91, an a* value between about −0.5 to about 0.5, and a b* value between about −0.5 to about 0.5 in the CIE L*a*b* (CIE LAB) color space, so the first layer 13 is white. The first layer 13 is formed by physical vapor deposition, such as magnetron sputtering or vacuum evaporation. The first layer 13 has a thickness of about 0.4 μm to about 1 μm.

The second layer 15 is formed by physical vapor deposition, such as Arc ion plating, magnetron sputtering or vacuum evaporation. The second layer 15 substantially includes substance M, oxygen (O) and nitrogen (N), wherein M is metal or non-metal, such as aluminum (Al) or silicon (Si). In the second layer 15, the atomic ratio of M, O, and N may be about (0.9-1.1):(0.5-1):(0.5-1), preferably 1:1:1. The second layer 15 presented with a transparency and high glossiness appearance. The second layer 15 has a thickness of about 50 nm to about 200 nm.

The first layer 13 combined with the second layer 15 cause the coated article 10 to present a bone china like appearance.

Figure 4:
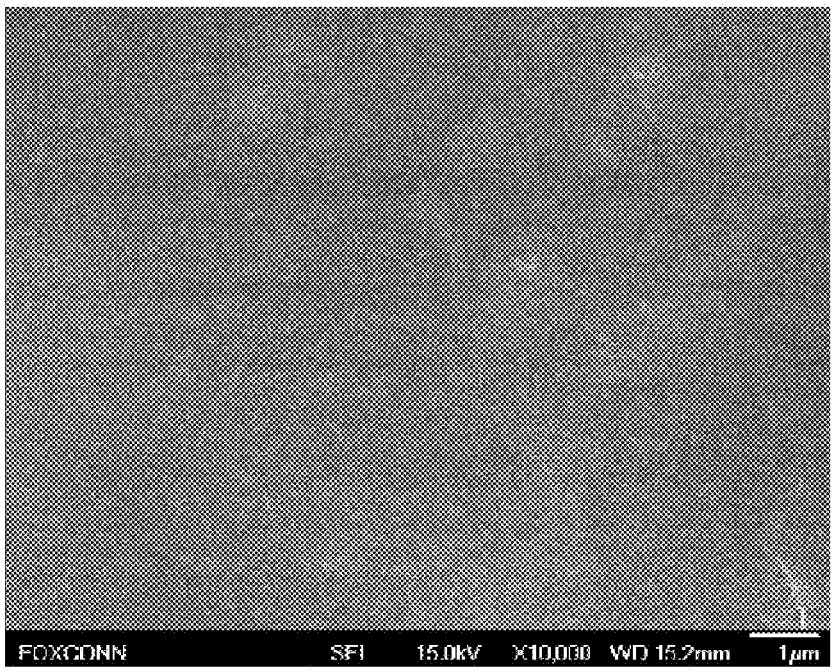
FIG. 4 is a scanning electron microscope image of the second outer surface of coated article of FIG. 1.

The third layer 17 formed by the vacuum evaporation. The third layer 17 cause the coated article 10 has an anti-fingerprint property. The third layer 17 is a silicon oxide ($SiO_2$) layer or an aluminum oxide ($Al_2O_3$) layer. The third layer 17 has a second outer surface 173 away from the second layer 15. Referring to FIG. 4, the average particle diameter of the second outer surface 173 is about 10 nm to about 30 nm. The roughness Ra of the second outer surface 173 is about 20 nm to about 50 nm. The third layer 17 is transparent and colorless. The third layer 17 has a thickness of about 0.5 μm to about 1.5 μm.

The 60 degree specula gloss (Gs 60°) of the third layer 17 is about 100-105. The L* value, a* value and b* value of the coated article 10 in the CIE L*a*b* (CIE LAB) color space is same with the value measured from the first layer 13.

A method for manufacturing the coated article 10 may include at least the following steps:

Providing a substrate 11. The substrate 11 may be made of metal, such as stain steel, aluminum, aluminum alloy, magnesium and magnesium alloy. The substrate 11 may instead be made of non-metal material, such as plastic. The substrate 11 has a first outer surface 113.

Polishing the first outer surface 113 of the substrate 11 to increase the glossiness of the substrate 11 and subsequent layers that will be formed on the substrate 11. Providing a finishing and polishing machine (not shown). The finishing and polishing machine includes a canvas polishing wheel. Polishing fluid is coated on the surface of the canvas polishing wheel to polish the first outer surface 113 for about 10 min to about 15 min. The polishing fluid is a suspension, which substantially comprises alumina powder and water.

Pretreating the substrate 11 by washing with a solution (e.g., alcohol or acetone) in an ultrasonic cleaner to remove contaminations, such as grease, or dirt. The substrate 11 is then dried.

Figure 2:
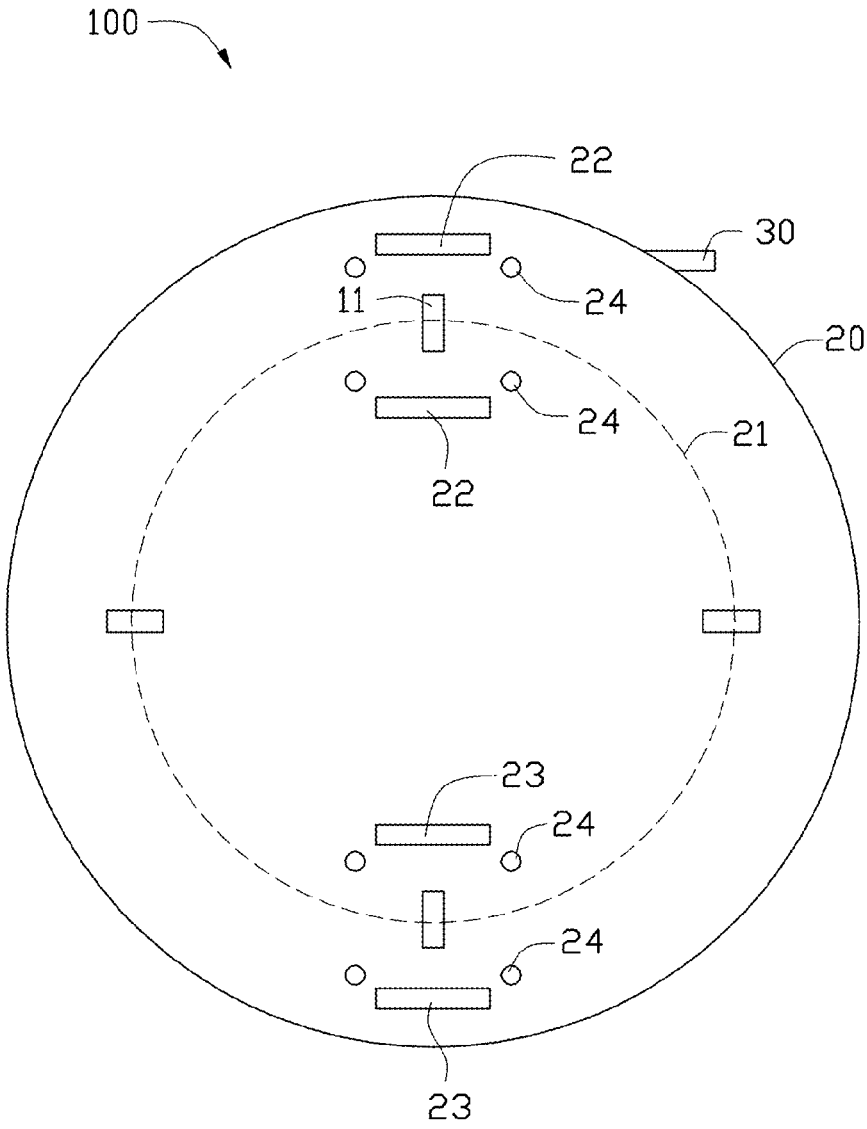
FIG. 2 is a schematic view of a vacuum sputtering coating machine for manufacturing the coated article of FIG. 1.

The substrate 11 is then cleaned by argon plasma cleaning. Providing a vacuum sputtering coating machine 100. Referring to FIG. 2, the vacuum sputtering coating machine 100 includes a sputtering coating chamber 20 and a first vacuum pump 30 connected to the sputtering coating chamber 20. The first vacuum pump 30 is used to evacuate the sputtering coating chamber 20. The vacuum sputtering coating machine 100 further includes a first rotating bracket 21, two first targets 22, two second targets 23, and a plurality of gas inlets 24. The first rotating bracket 21 rotates the substrate 11 in the sputtering coating chamber 20 relative to the first targets 22 and the second targets 23. The two first targets 22 face each other, and are located on opposite sides of the first rotating bracket 21, and the same arrangement applied to the two second targets 23. In this exemplary embodiment, the first targets 22 are made of Al, Al alloy, Zn and Zn alloy, the second targets 23 are made of Al, Al alloy, Si or Si alloy. When the first targets 22 are made of Al alloy, the mass percentage of the Al is about 80%-90%; when the first targets 22 are made of Zn alloy, the mass percentage of the Zn is about 80%-90%. When the second targets 23 are made of Al alloy, the mass percentage of the Al is about 80%-90%; when the second targets 23 are made of Si alloy, the mass percentage of the Si is about 80%-90%.

Cleaning the substrate 11 by argon (Ar) plasma. The substrate 11 is retained on a first rotating bracket 21 in a sputtering coating chamber 20. The vacuum level inside the sputtering coating chamber 20 is set to about $8.0*10^{-3}$ Pa. Argon gas is fed into the sputtering coating chamber 20 at a flux rate about 100 Standard Cubic Centimeters per Minute (sccm) to about 400 sccm from the gas inlets 24. A bias voltage applied to the substrate 11 may be between about −200 volts (V) and about −500 V. The argon particles strike against and clean the surface. Plasma cleaning the substrate 11 may take from about 3 min to about 20 min.

A first layer 13 is deposited on the substrate 11. The temperature in the sputtering coating chamber 20 is set between about 20° C. (Celsius degree) and about 200° C. Argon may be used as a working gas and is injected into the sputtering coating chamber 20 at a flow rate from about 100 sccm to about 300 sccm. The first targets 22 in the sputtering coating chamber 20 are evaporated at a power between about 7 kW and about 13 kW. A bias voltage applied to the substrate 11 may be between about −100 V and about −300 V, for between about 10 minutes (min) and about 30 min, to deposit the first layer 13 on the substrate 11.

A second layer 15 is deposited on the first layer 13. The temperature in the sputtering coating chamber 20 is set between about 20° C. and about 200° C. Argon may be used as a working gas and is injected into the sputtering coating chamber 20 at a flow rate from about 100 sccm to about 300 sccm. Nitrogen ($N_2$) and oxygen ($O_2$) may be used as reaction gases. The nitrogen may have a flow rate of about 80 sccm to about 200 sccm, the oxygen may have a flow rate of about 80 sccm to about 200 sccm. The second targets 23 in the sputtering coating chamber 20 are evaporated at a power between about 8 kW and about 10 kW. A bias voltage applied to the substrate 11 may be between about −100 V and about −300 V, for between about 30 min and about 45 min, to deposit the second layer 15 on the first layer 13. The Gs 60° of the second layer 15 is about 150-200.

Figure 3:
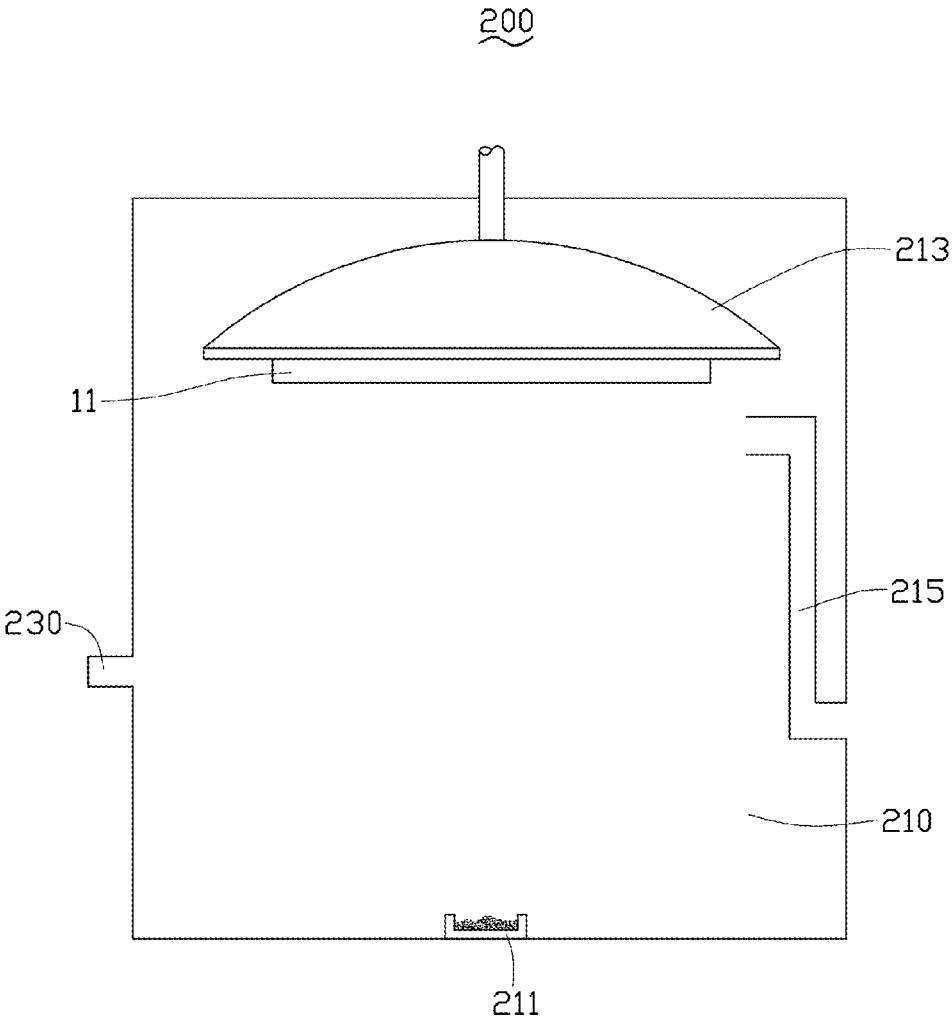
FIG. 3 is a schematic view of a vacuum evaporation coating machine for manufacturing the coated article of FIG. 1.

Providing a vacuum evaporation coating machine. Referring FIG. 3, the vacuum evaporation coating machine 200 includes a evaporation coating chamber 210 and a second vacuum pump 230 connected to the evaporation coating chamber 210. The second vacuum pump 230 is used to evacuate the evaporation coating chamber 210. The evaporation coating chamber 210 further includes an evaporation target 211, a second first rotating bracket 213 and a second gas inlets 215. The evaporation target 211 is made of silicon oxide or aluminum oxide.

A third layer 17 is deposited on the second layer 15. The substrate 11 is retained on the second rotating bracket 213. The vacuum level inside the evaporation coating chamber 210 is set to about $6.0*10^{-3}$ Pa to about $8.0*10^{-3}$ Pa. The temperature in the evaporation coating chamber 210 is set between about 50° C. (Celsius degree) and about 100° C. Oxygen ($O_2$) may be used as supplement gas to supplement oxygen (O) lost during deposition of the third layer 17 and is injected into the evaporation coating chamber 210 at a flow rate from about 10 sccm to about 30 sccm. The deposit rate may be about 8 kilo angstroms per second (kÅ/S)−20 kÅ/S. The electric current is set about 8 milliampere (mA) to about 20 mA. The deposition of the third layer 17 take about 1 minute and about 10 min.

It is to be understood that the first layer 13 and the second layer 15 may instead be deposited by vacuum evaporation or arc ion plating.

It is to be understood that the third layer 13 may instead be deposited by magnetron sputtering or arc ion plating.

The first layer 13 is white, the second layer 15 deposited on the first layer 13 is a transparent layer, and the third layer 17 is a transparent layer with an anti-fingerprint property. Thus the first layer 13 and the second layer 15 combined with the third layer 17 cause the coated article 10 to present a bone china like appearance and with an anti-fingerprint property.

It is to be understood, however, that even through numerous characteristics and advantages of the exemplary disclosure have been set forth in the foregoing description, together with details of the system and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A coated article, comprising:

a substrate;

a first layer deposited on the substrate, the first layer substantially consisting of one material selected from the group consisting of aluminum, aluminum alloy, zinc, and zinc alloy, the first layer has an L* value between about 85 to about 91, an a* value between about −0.5 to about 0.5, and a b* value between about −0.5 to about 0.5 in the CIE L*a*b* color space;

a second layer deposited on the first layer, the second layer substantially including substance M', O and N, wherein M' is Al or Si; and a third layer deposited on the second layer, the third layer being an aluminum oxide layer or a silicon oxide layer.

2. The coated article as claimed in claim 1, wherein when the first layer substantially consists of aluminum alloy, the mass percentage of Al is about 80-90%.

3. The coated article as claimed in claim 1, wherein when the first layer substantially consists of zinc alloy layer, the mass percentage of Zn is about 80-90%.

4. The coated article as claimed in claim 1, wherein in the second layer, the atomic ratio of M, O, and N is about (0.9-1.1):(0.5-1):(0.5-1).

5. The coated article as claimed in claim 1, wherein in the second layer, the atomic ratio of M, O, and N is 1:1:1.

6. The coated article as claimed in claim 1, wherein the third layer comprises a second outer surface away from the second layer, the mean particle diameter of the second outer surface is about 10 nm to about 30 nm.

7. The coated article as claimed in claim 1, wherein the third layer comprises a second outer surface away from the second layer, the roughness Ra of the second outer surface is about 20 nm to about 50 nm.

8. The coated article as claimed in claim 1, wherein the first layer has a thickness of about 0.4 μm to about 1 μm.

9. The coated article as claimed in claim 1, wherein the second layer has a thickness of about 50 nm to about 200 nm.

10. The coated article as claimed in claim 1, wherein the third layer has a thickness of about 0.5 μm to about 1.5 μm.

11. The coated article as claimed in claim 1, wherein the 60 degree specula gloss of the third layer is about 100-105.

12. The coated article as claimed in claim 1, wherein the coated article has an L* value between about 85 to about 91, an a* value between about −0.5 to about 0.5, and a b* value between about −0.5 to about 0.5 in the CIE L*a*b* color space.

13. The coated article as claimed in claim 1, wherein the second layer is transparent and colorless.

14. The coated article as claimed in claim 1, wherein the third layer is transparent and colorless.

* * * * *